US005911368A

United States Patent [19]

Davignon

[11] Patent Number: 5,911,368

[45] Date of Patent: Jun. 15, 1999

[54] CABLE TIE

[75] Inventor: Paul A. Davignon, Uxbridge, Mass.

[73] Assignee: Avery Dennison Corporation, Pasadena, Calif.

[21] Appl. No.: 09/079,441

[22] Filed: May 15, 1998

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P; 248/74.3

[56] References Cited

U.S. PATENT DOCUMENTS

| | | | |
|---|---|---|---|
| 3,597,803 | 8/1971 | Van Neil | 24/16 PB |
| 3,654,669 | 4/1972 | Fulton . | |
| 4,240,183 | 12/1980 | Sumimoto et al. | 24/16 PB |
| 4,377,887 | 3/1983 | Valestin . | |
| 4,665,588 | 5/1987 | Nakano . | |
| 4,854,014 | 8/1989 | Ueno | 24/16 PB |
| 5,117,575 | 6/1992 | Desmond . | |
| 5,146,654 | 9/1992 | Caveney et al. | 24/17 AP |
| 5,224,244 | 7/1993 | Ikeda et al. . | |
| 5,293,668 | 3/1994 | Tibiletti . | |
| 5,377,387 | 1/1995 | Freed . | |
| 5,395,343 | 3/1995 | Iscovich . | |
| 5,402,971 | 4/1995 | Bower | 248/74.3 |
| 5,443,155 | 8/1995 | Robinson . | |
| 5,537,719 | 7/1996 | Freed . | |
| 5,630,252 | 5/1997 | Wells . | |
| 5,636,412 | 6/1997 | Lodi et al. . | |
| 5,642,554 | 7/1997 | Sorensen et al. . | |
| 5,651,376 | 7/1997 | Thompson . | |
| 5,758,390 | 6/1998 | Villeneuve | 24/16 PB |

FOREIGN PATENT DOCUMENTS

| | | | |
|---|---|---|---|
| 2556411 | 6/1977 | Germany | 24/16 PB |

*Primary Examiner*—Victor N. Sakran
*Attorney, Agent, or Firm*—Kriegsman & Kriegsman

[57] ABSTRACT

A one piece cable tie for forming a plurality of objects such as cables into a bundle. The cable tie includes an elongated flexible strap having a first end, a second end, a top planar surface, a bottom planar surface, a first recessed portion formed in the top planar surface, a second recessed portion formed in the bottom planar surface, a first set of ratchet-shaped teeth formed within the first recessed portion and a second set of ratchet-shaped teeth formed within the second recessed portion. The cable tie further includes a locking head integrally formed to the first end of the strap. The locking head includes a top surface and a bottom surface. The locking head also includes an inner channel wall, an outer channel wall and a pair of sidewalls which together define a strap accepting channel therebetween, the strap accepting channel having a first open end formed in the top surface of the locking head and a second open end formed in the bottom surface of the locking head. A locking pawl is pivotally connected to the inner channel wall of the locking head and a projection is fixedly connected to the outer channel wall of the locking head. The locking pawl and the projection lockably engage the teeth on opposite sides of the strap to prevent withdrawal of the strap from the locking head when the second end of the strap is inserted into the strap accepting channel through the first open end or when the second end of the strap is inserted into the strap accepting channel through the second open end.

12 Claims, 5 Drawing Sheets

CABLE TIE

BACKGROUND OF THE INVENTION

The present invention relates to cable ties.

Cable ties, also known as harnessing devices, are well known in the art and are commonly used to bundle a plurality of objects, such as cables. Cable ties typically comprise an elongated strip of material, such as plastic, having a head at one end, a tail at the other end and either teeth or rungs disposed along the length of the strip. Feeding the tail of the tie through the head results in the tie taking the shape of a loop with the tail engaging and being locked in position by a pawl inside the head, the tail being incapable of removal once it is inserted in the head.

As an example of one type of cable tie, in U.S. Pat. No. 5,642,554 to S. C. Sorensen et al, there is disclosed a cable tie having an enhanced locking engagement between a pawl and ratchet teeth on a tongue. The cable tie includes an elongated tongue and a locking head having a movable pawl that is hinged at one side of an opening in the locking head across the opening from an abutment surface for locking engagement with a first set of ratchet teeth on one broad side of the tongue when the tip of the tongue has been inserted through the opening and teeth on the abutment surface for locking engagement with a second set of ratchet teeth on the other broad side of the tongue when the tip of the tongue has been inserted through the opening, and in which the side of the pawl including the pawl teeth converges toward the opposite side of the pawl in the direction of insertion, locking engagement is enhanced by the locking surface of at least one pawl tooth extending toward the apex of such tooth at an angle inclined toward the direction of insertion for locking engagement with a tooth of the first set of ratchet teeth; and by the locking surface of at least one of the first set of ratchet teeth extending toward the apex of such tooth at an angle inclined away from the direction of insertion for locking engagement with a pawl tooth.

As another example of another type of cable tie, in U.S. Pat. No. 5,636,412 to F. Lodi et al, there is disclosed a substantially permanent, fixed-circumference, non-abrasive binding device for gathering and binding plural articles, including a locking head, a tail, and an elongate strap therebetween. The head and tail ends include cooperative locking means for securing the tail end in the locking head. The tail end includes outwardly projecting tail barbs to facilitate pulling the tail end through the locking head, and subsequently to facilitate engagement of locking barbs located on the end of the strap with barb stops located in the head. The score line is preformed across the tail end at a point between the locking barbs and the tail end, to provide for a break—any tail which can be removed after engagement of the locking barbs with the barb stops in the head. Upon engagement of the locking barbs with the barb stops, the score line is at a position slightly inside of the locking head so that no sharp or abrasive edge will be exposed after the tail end is broken off.

SUMMARY OF THE INVENTION

It is an object of this invention to provide a new and improved cable tie.

It is another object of this invention to provide a one-piece cable tie.

It is yet another object of this invention to provide a cable tie as described above which provides for the secure bundling of a plurality of objects.

It is still another object of this invention to provide a cable tie as described above which has a minimum number of parts, is simple in construction and is easy to use.

Accordingly, there is provided a one piece cable tie for forming a plurality of objects such as cables into a bundle, said cable tie comprising an elongated flexible strap having a first end and a second end, and a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, wherein said locking head lockably engages said strap upon insertion of said strap into the strap accepting channel when the second end of said strap is inserted into the strap accepting channel through the first open end and when said strap is inserted into said strap accepting channel through the second open end.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
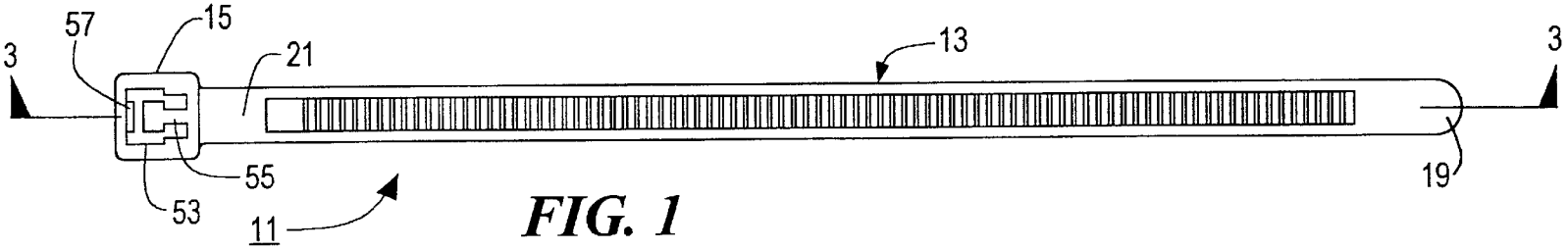
FIG. 1 is a top view of a cable tie constructed according to the teachings of the present invention.
Figure 2:
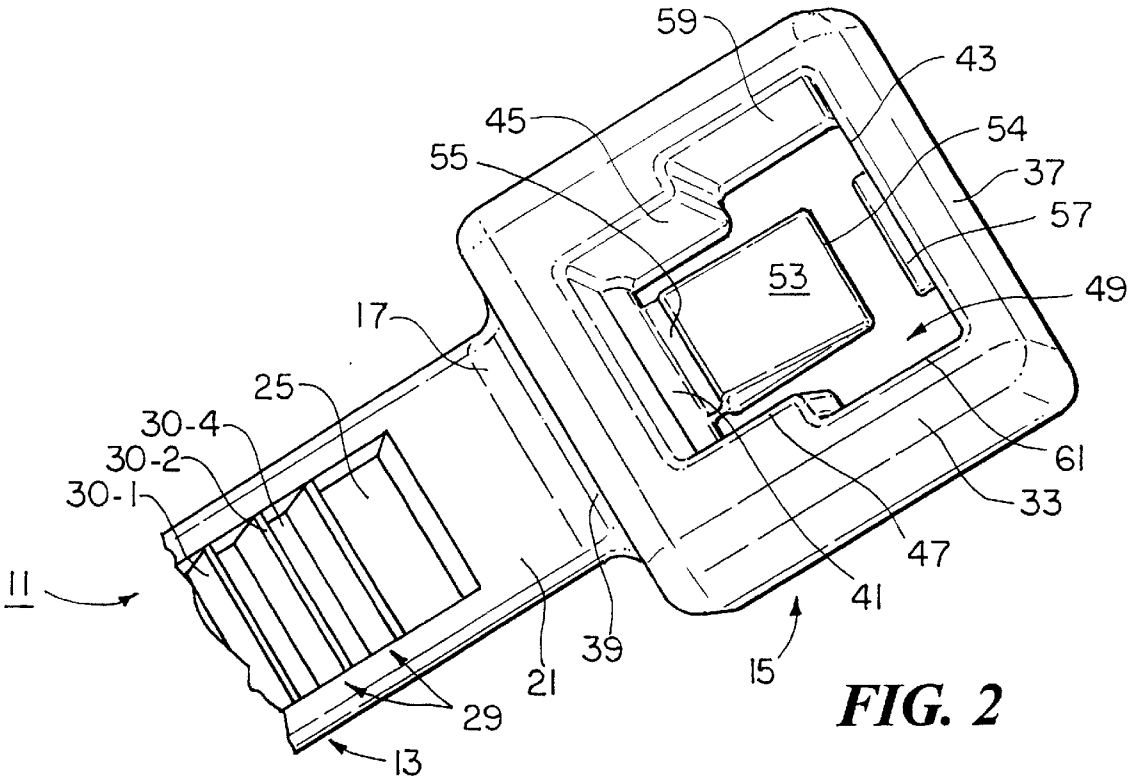
FIG. 2 is an enlarged, top perspective view, broken away in part, of the cable tie shown in FIG. 1.

Referring now to the drawings, there is shown a cable tie constructed according to the teachings of the present invention, the cable tie being identified by reference numeral 11. Cable tie 11 can be used to bundle together a plurality of cables C; however, it is to be understood that the invention is not exclusively limited to bundling cables, but rather may be used to bundle together other objects.

Cable tie 11 is a one piece tie comprising an elongated strap 13 and a locking head 15.

Figure 3:
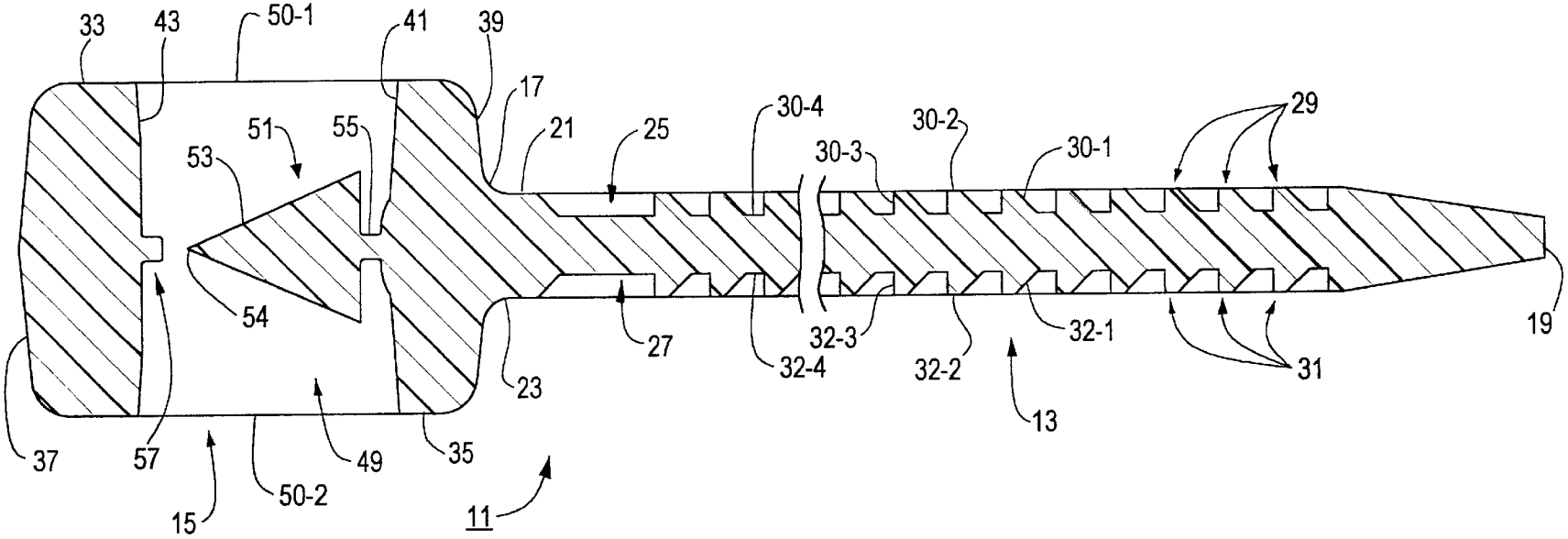
FIG. 3 is an enlarged, side, section view, broken away in part, of the cable tie shown in FIG. 1 taken along lines 3—3.

Elongated strap 13 is constructed of a flexible material such as plastic, nylon or a high modulus elastomer and includes a first end 17, a second end 19, a top planar surface 21 and a bottom planar surface 23. As shown in FIG. 3, the thickness of strap 13 tapers in slightly at second end 19 to enable strap 13 to be easily inserted into locking head 15.

Strap 13 further includes a first recessed portion 25 formed in top planar surface 21 and a second recessed portion 27 formed in bottom planar surface 23. A first set of ratchet shaped teeth 29 extend transversely along the length of first recessed portion 25 and a second set of ratchet shaped teeth 31, identical in size, shape and number with first set of ratchet shaped teeth 29, extend transversely along the length of second recessed portion 27.

It should be noted that second set of teeth 31 are formed within second recessed portion 27 in symmetrical relation to the manner in which first set of teeth 29 are formed within first recessed portion 25. As will be described in detail below, the symmetrical construction of strap 13 enables strap 13 to be fed into locking head 15 in either of two opposite directions.

Each of teeth 29 comprise an angled front wall 30-1, a flat top surface 30-2, a vertical rear wall 30-3 and a flat bottom surface 30-4. Flat top surface 30-2 of each of teeth 29 protrudes up to a point just beneath the level of top planar surface 21. Flat bottom surface 30-4 of each of teeth 29 is colinear with the deepest portion of first recessed portion 25.

Similarly, each of teeth 31 comprise an angled front wall 32-1, a flat top surface 32-2, a vertical rear wall 32-3 and a flat bottom surface 32-4. Flat top surface 32-2 of each of teeth 31 protrudes up to a point just beneath the level of bottom planar surface 23. Flat bottom surface 32-4 of each of teeth 31 is colinear with the deepest portion of second recessed portion 27.

Locking head 15 comprises a top surface 33, a bottom surface 35, an outer end wall 37 and an inner end wall 39. Inner end wall 39 of locking head 15 is integrally formed to first end 17 of elongated strap 13 to make cable tie 11 a unitary device.

Locking head 15 also comprises an inner channel wall 41, an outer channel wall 43, a first sidewall 45 and second sidewall 47 which together define a strap accepting channel 49 therebetween. As shown in FIG. 3, strap accepting channel 49 includes a first open end 50-1 formed in top surface 33 and a second open end 50-2 formed in bottom surface 35.

Locking head 15 further comprises a pawl 51 which is integrally connected to inner channel wall 41 of locking head 15 so as to form a unitary device. Pawl 51 includes a symmetrically shaped arrowhead 53 having a tip 54. Arrowhead 53 is pivotally connected to inner channel wall 41 by a thin stem 55. The size and shape of thin stem 55 enables arrowhead 53 to be pivoted in two opposing directions, namely, up towards first open end 50-1 and down towards second open end 50-2, as will be discussed further in detail below.

Locking head 15 additionally comprises a rectangularly shaped projection 57 which is integrally connected to outer channel wall 43 of locking head 15 to form a unitary device. Projection 57 extends into strap accepting channel 49 and is symmetrical in its construction.

As will be discussed in further detail below, pawl 51 and projection 57 are together positioned within locking head 15 so as to engage strap 13 and preclude its removal from locking head 15 regardless of whether strap 13 is fed into strap accepting channel 49 through first open end 50-1 or whether strap 13 is fed into strap accepting channel 49 through second open end 50-2.

First sidewall 45 and second sidewall 47 are each shaped to include a recessed guide slot 59 and 61, respectively. Recessed guide slots 59 and 61 serve to facilitate the insertion of the free end of tail 13 into locking head 15.

Tie 11 may be used to secure a plurality of cables C as a bundle in the following manner. Second end 19 of strap 13 is wrapped around cables C and is inserted through strap accepting channel 49 to form a loop. As noted above, second end 19 of strap 13 can be inserted into strap accepting channel 49 in either of two opposing directions, namely in a first direction as represented by arrow A in FIG. 4 or in a second direction as represented by arrow B in FIG. 5.

Figure 4:
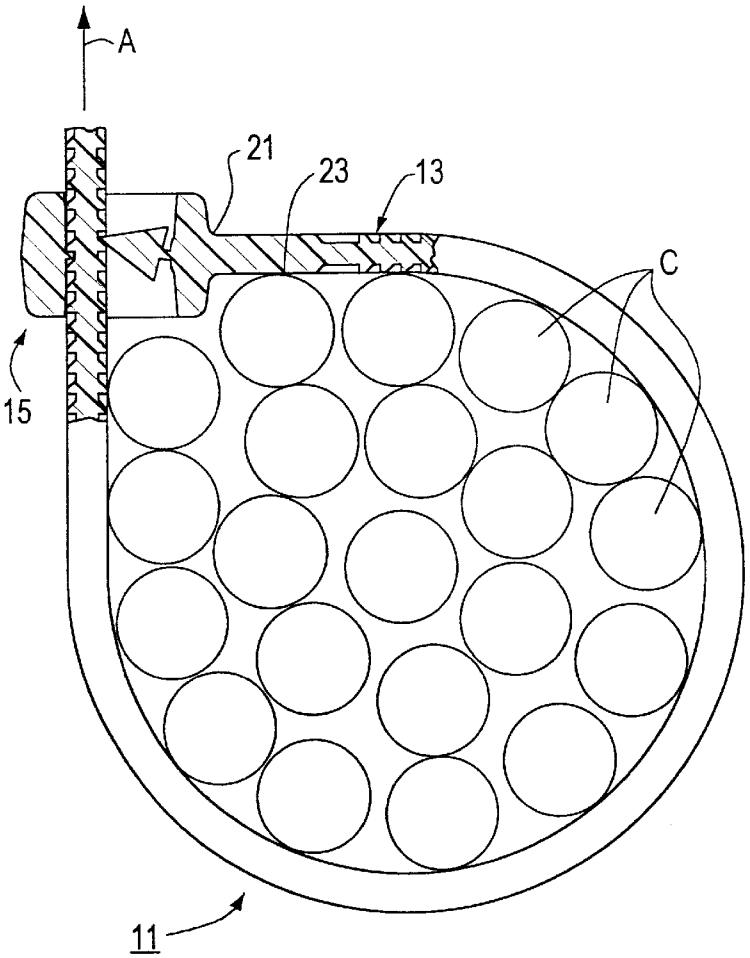
FIG. 4 is a side view of the cable tie shown in FIG. 1, the tail of the cable tie being shown inserted into the locking head in a first direction to form a loop around a plurality of cables, the cable tie being shown partially in section and broken away in part.
Figure 6:
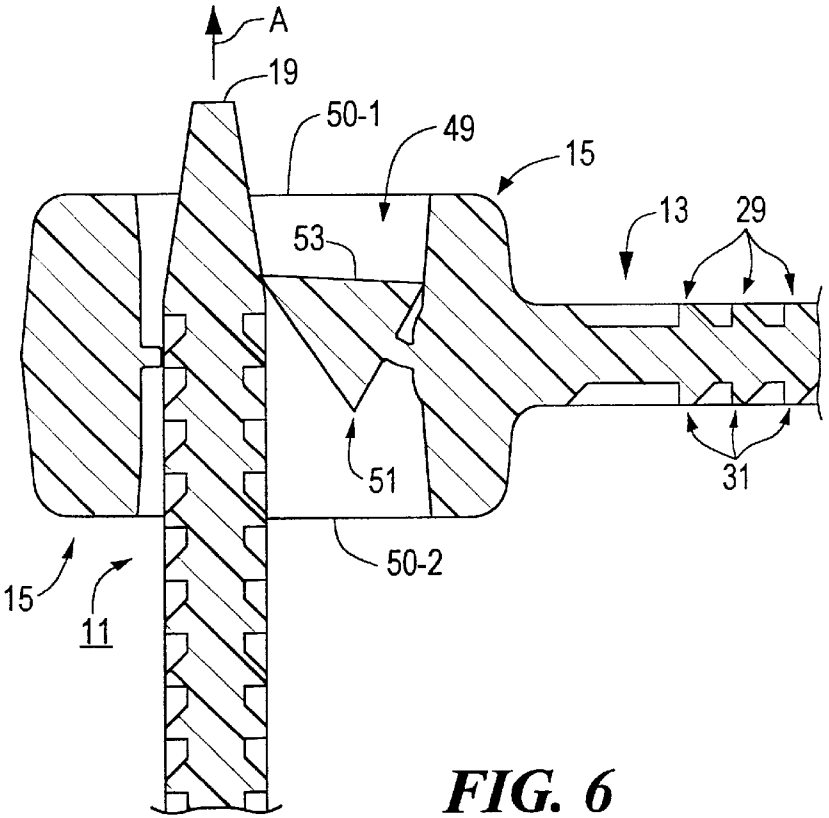
FIG. 6 is an enlarged, side, section view, broken away in part, of one step in the insertion of the tail of cable tie of FIG. 4 into the locking head in the first direction, the cable tie being shown without the plurality of cables.

Second end 19 of strap 13 can be inserted into strap accepting channel 49 in the first direction, as represented by arrow A in FIG. 4, to wrap cable tie 11 around the plurality of cables C. Specifically, second end 19 is first inserted into strap accepting channel 49 through second open end 50-2, as shown by arrow A in FIG. 6, the insertion of second end 19 causing arrowhead 53 of pawl 51 to pivot upwards towards first open end 50-1. With arrowhead 53 of pawl 51 pivoted up towards first open end 50-1, second end 19 of strap 13 can be further advanced into strap accepting channel 49 and out through first open end 50-1 to reduce the size of the loop, thereby drawing tie 11 tight around the bundle of cables C.

Figure 7:
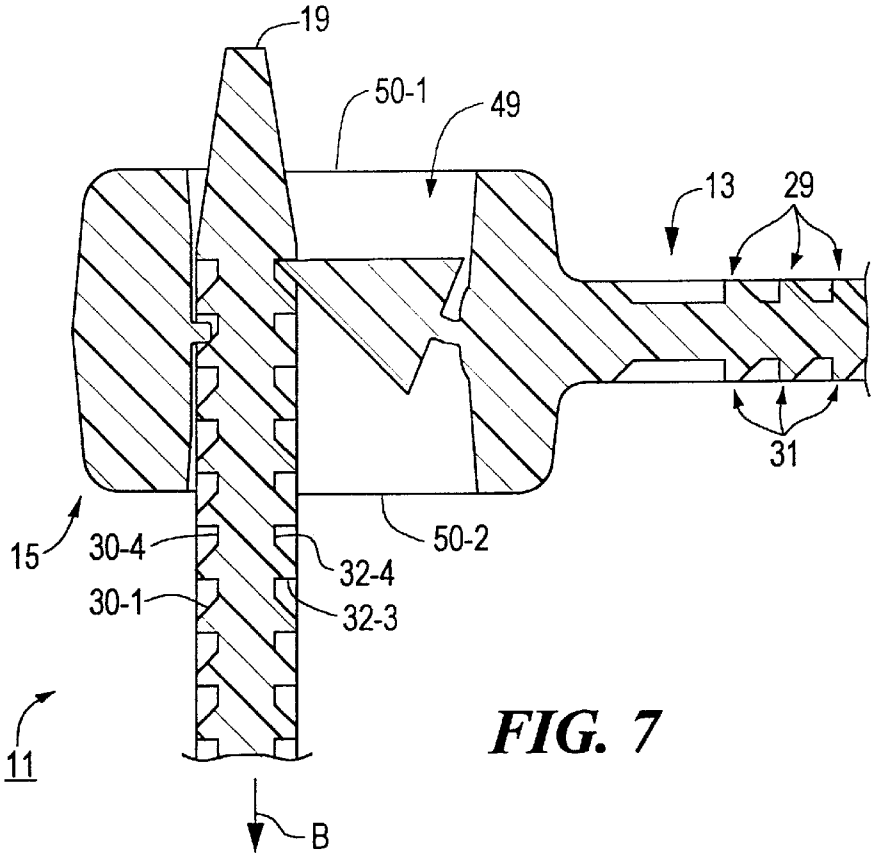
FIG. 7 is an enlarged, side, section view, broken away in part, of another step in the insertion of the tail of the cable tie of FIG. 4 into the locking head in the first direction, the cable tie being shown without the plurality of cables.
Figure 8:
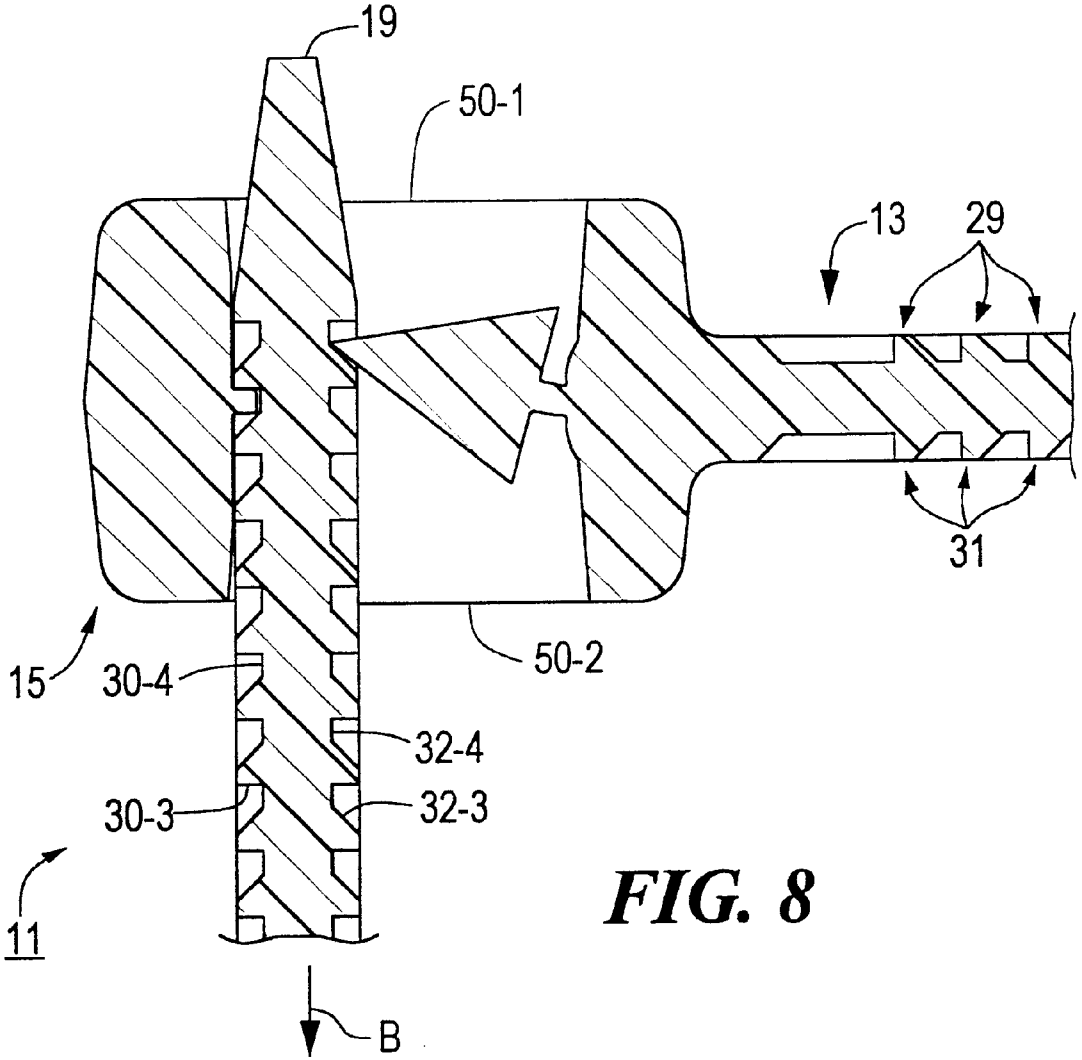
FIG. 8 is an enlarged, side, section view, broken away in part, of another step in the insertion of the tail of the cable tie of FIG. 4 into the locking head in the first direction, the cable tie being shown without the plurality of cables.

Movement of second end 19 in the direction towards second open end 50-2, as shown by arrow B in FIG. 7, causes tip 54 of arrowhead 53 to engage one of teeth 31 at the juncture of vertical rear wall 32-3 and flat bottom surface 32-4 which, in turn, causes arrowhead 53 of pawl 51 to pivot back down towards second open end 50-2. Pivoting of arrowhead 53 down towards second open end 50-2 causes arrowhead 53 to urge strap 13 towards outer channel wall 43 so that projection 57 contacts flat bottom surface 30-4 of one of teeth 29. As second end 19 continues to move down towards second open end 50-2, as shown by arrow B in FIG. 8, arrowhead 53 continues to pivot downward such that top 54 engages one of teeth 31 at the juncture of flat bottom surface 32-4 and angled front wall 32-1. In addition, as second end 19 continues to move down towards second open end 50-2, as shown by arrow B in FIG. 8, projection 57 contacts vertical rear wall 30-3 of one of teeth 29. As can be appreciated, the engagement of arrowhead 53 and projection 57 on opposite sides of strap 13 serves to lockably secures strap 13 within channel 49 and thereby prevent withdrawal of strap 13 from locking head 15.

Figure 5:
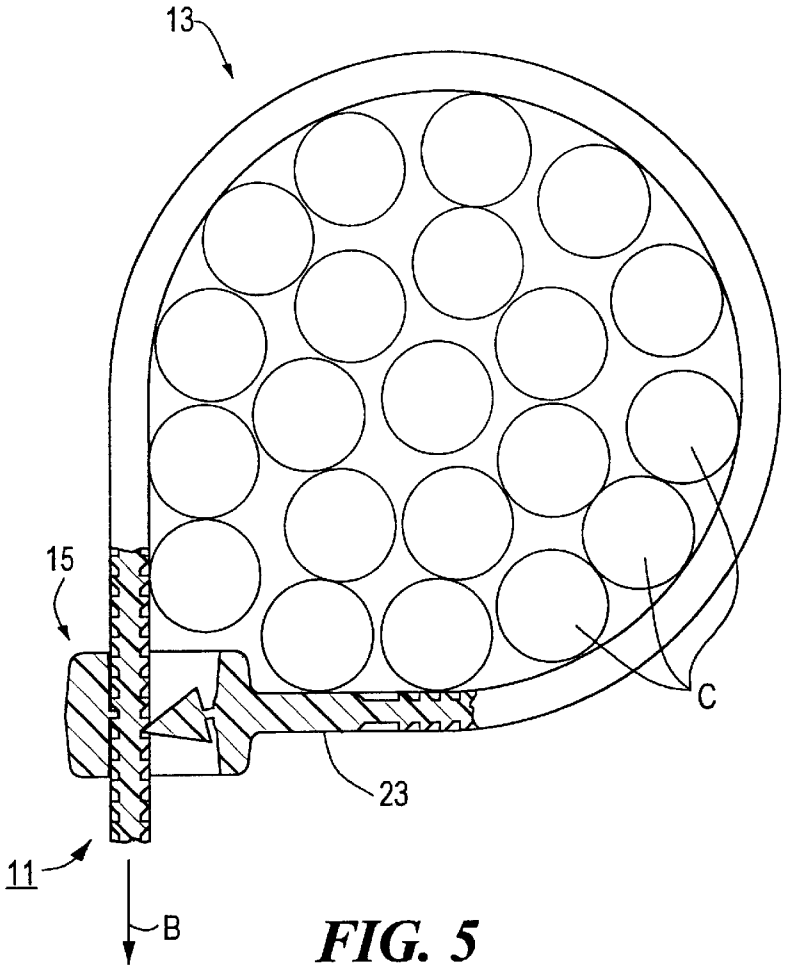
FIG. 5 is a side view of the cable tie shown in FIG. 1, the tail of the cable tie being shown inserted into the locking head in a second direction to form a loop around a plurality of cables, the cable tie being shown partially in section and broken away in part.

As noted above, second end 19 of strap 13 can also be inserted into strap accepting channel 49 in a second direction, as represented by arrow B in FIG. 5, to wrap cable tie 11 around the plurality of cables C. Due the symmetrical construction of cable tie 11, cable tie 11 functions in a similar manner when second end 19 of strap 13 is inserted into strap accepting channel 49 in the first direction as when second end 19 of strap 13 is inserted into strap accepting channel 49 in the second direction.

The embodiment shown in the present invention is intended to be merely exemplary and those skilled in the art shall be able to make numerous variations and modifications to it without departing from the spirit of the present invention. For example, it is to be understood that alternative types of locking pawls could be used in cable tie 11 in place of pawls 49 and 51 without departing from the spirit of the present invention. Furthermore, although cable tie 11 is shown as being a unitary structure, it is to be understood that tie 11 could be manufactured as a non-unitary structure without departing from the spirit of the present invention. All such variations and modifications are intended to be within the scope of the present invention as defined in the appended claims.

What is claimed is:

1. A one piece cable tie for forming a plurality of objects such as cables into a bundle, said cable tie comprising:

(a). an elongated flexible strap having a first end, a second end, a top surface, a bottom surface, a first set of teeth formed on the top surface of said strap and a second set of teeth formed on the bottom surface of said strap, and (b). a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, said locking head further comprising a pawl which lockably engages one of said sets of teeth to prevent withdrawal of said strap from said locking head when the second end of said strap is inserted into the strap accepting channel through the first open end and which lockably engages the other of said sets of teeth to prevent withdrawal of said strap from said locking head when the second end of said strap is inserted into the strap accepting channel through the second open end.

2. The cable tie as claimed in claim 1 wherein said pawl pivots in two opposite directions.

3. The cable tie as claimed in claim 2 wherein said locking head further comprises a fixed projection.

4. A one piece cable tie for forming a plurality of objects such as cables into a bundle, said cable tie comprising:

(a). an elongated flexible strap having a first end, a second end, a top surface, a bottom surface, a first set of teeth formed on the top surface of said strap and a second set of teeth formed on the bottom surface of said strap, and (b). a locking head integrally formed to the first end of said strap, said locking head comprising a top surface and a bottom surface, said locking head further comprising an inner channel wall, an outer channel wall, and a pair of sidewalls which together define a strap accepting channel therebetween, the strap accepting channel having a first open end formed in the top surface of said locking head and a second open end formed in the bottom surface of said locking head, said locking head further comprising a fixed projection and a pawl, the pawl being capable of pivoting in two opposite directions, (c). wherein said projection engages one of said sets of teeth and said pawl engages the other of said sets of teeth, said projection and said pawl together preventing withdrawal of said strap from said locking head either when the second end of said strap is inserted into the strap accepting channel through the first open end or when the second end of said strap is inserted into the strap accepting channel through the second open end.

5. The cable tie as claimed in claim 4 wherein the first set of teeth and the second set of teeth are ratchet shaped.

6. The cable tie as claimed in claim 5 wherein said strap further comprises a first recessed portion formed in the top surface and a second recessed portion formed in the bottom surface.

7. The cable tie as claimed in claim 6 wherein the first set of teeth are formed within the first recessed portion and the second set of teeth which are formed within the second recessed portion.

8. The cable tie as claimed in claim 7 wherein the first set of teeth extend transversely along the length of the first recessed portion and the second set of teeth extend transversely along the length of the second recessed portion.

9. The cable tie as claimed in claim 8 wherein said pawl is pivotally connected to the inner channel wall.

10. The cable tie as claimed in claim 9 wherein said projection is fixedly connected to the outer channel wall.

11. The cable tie as claimed in claim 10 wherein said pawl comprises an arrowhead which is pivotally connected to the inner channel wall by a thin stem.

12. The cable tie as claimed in claim 11 wherein said arrowhead is symmetrical in shape.

* * * * *